US006435361B2

(12) United States Patent
Franzen et al.

(10) Patent No.: US 6,435,361 B2
(45) Date of Patent: Aug. 20, 2002

(54) LIFTING DEVICE FOR INCREASING THE PERFORMANCE OF A HANDLING APPARATUS FOR ISO CONTAINERS

(75) Inventors: Hermann Franzen, Mönchengladbach; Joachim Kröll, Jüchen; Janis Moutsokapas, Monheim, all of (DE)

(73) Assignee: Atecs Mannesmann AG, Düsseldorf (DE)

( * ) Notice: Subject to any disclaimer, the term of this patent is extended or adjusted under 35 U.S.C. 154(b) by 68 days.

(21) Appl. No.: 09/726,934

(22) Filed: Nov. 30, 2000

(30) Foreign Application Priority Data

Nov. 30, 1999 (DE) ..... 199 58 501

(51) Int. Cl.[7] ..... B66C 19/00; B66C 5/02
(52) U.S. Cl. ..... 212/325; 414/140.3; 414/141.3
(58) Field of Search ..... 414/140.3, 141.3; 212/325

(56) References Cited

U.S. PATENT DOCUMENTS 4,293,077 A 10/1981 Makino ..... 212/325
5,603,598 A * 2/1997 Hasegawa et al. ..... 414/140.3

FOREIGN PATENT DOCUMENTS

DE 34 30 524 2/1986
DE 43 29 470 3/1995
DE 297 19 466 5/1998
DE 197 40 814 4/1999
JP 1313300 * 12/1989 ..... 212/325

* cited by examiner

*Primary Examiner*—Steven A. Bratlie
(74) *Attorney, Agent, or Firm*—Cohen, Pontani, Lieberman & Pavane

(57) ABSTRACT

The invention relates to a lifting device for increasing the performance of a handling apparatus for ISO containers, in particular for increasing the performance of a container bridge in a terminal having automated inward and outward transport of the containers by means of self-propelled transport vehicles, and having at least one container load-lifting means in the form of a spreader and devices for the intermediate positioning of the containers within the handling apparatus for the purpose of fitting or removing the twist locks, and platforms for the personnel occupied in doing this. The intermediate positioning of the containers is carried out in a lifting device which can be positioned above the transport vehicles and comprises a shaft-like base frame with vertical guides for the container suspended on the spreader, and a lifting frame which engages around the container, is arranged such that it can be raised and lowered underneath the shaft-like base frame and which, after the container has been detached from the spreader, can be lowered with the container in the direction of the transport vehicle.

18 Claims, 14 Drawing Sheets

LIFTING DEVICE FOR INCREASING THE PERFORMANCE OF A HANDLING APPARATUS FOR ISO CONTAINERS

BACKGROUND OF THE INVENTION

1. Field of the Invention

The invention relates to a lifting device for increasing the performance of a handling apparatus for ISO containers, in particular for increasing the performance of a container bridge in a terminal having automated inward and outward transport of the containers by means of self-propelled transport vehicles, and having at least one container load-lifting means in the form of a spreader and devices for the intermediate positioning of the containers within the handling apparatus for the purpose of fitting or removing the twist locks, and platforms for the personnel occupied in doing this.

2. Description of the Related Art

German Utility Model 297 19 466 has disclosed a handling system for containers in which a container bridge formed by a portal frame is used. The portal frame is supported on a chassis which can be moved along rails parallel to the quay to which a ship is moored. The portal frame has a boom which extends outward beyond the supporting construction, both on the water side and on the land side and to which running rails for a trolley are fitted, the latter transporting containers from the ship to the quay and vice versa with the aid of a spreader. The spreader is designed in such a way that, being locked automatically to the container by means of manipulation by the crane driver, it can be brought into engagement or out of engagement with them.

The productivity-determining factor of such a handling apparatus is the time taken for one load cycle of the trolley, namely the time which is needed to convey the containers between the standing areas and the removal or fitting of the twist locks. As is known, these are used to secure the containers stacked on top of one another on the standing areas against slipping during transport, in particular during transport by ship. The containers are locked to one another by the twist locks engaging in openings in the fittings and the parts arranged inside the fittings being rotated. For the most part, semiautomatic twist locks are used which, during loading, are connected to the lower fittings of a container in a prior position. When the container is placed onto another container, the twist locks are automatically latched with the fitting of the lower container, so that these two containers are then firmly connected to each other.

During the unloading of the containers from the standing location, firstly the locks to the respective lower container or the container vehicle are cancelled by the personnel and the respective upper container, with the twist locks still located on it, is conveyed from the ship to the quay. However, before the container is set down onto the surface of the quay, the twist locks have to be removed, which is likewise done manually, by the personnel employed for this purpose reaching under the suspended container and releasing and removing the twist locks manually. Conversely, during loading, the container is firstly lifted to such an extent that the twist locks can initially be inserted into the lower fittings by hand, before the container is transported to its standing location.

A solution disclosed by the German Utility Model 297 19 466 describes the loosening and loading of the containers in two overlapping phases, two trolleys being used, of which the first trolley performs the transport of the container from the ship to a manipulation platform, and the second trolley performs the transport of the container from the platform to the desired track on the surface of the quay. There, a vehicle is ready to accept the container. The two trolleys which transport the containers and overlap in time reduce the productive working cycle time, since it has been established that less time is needed including the removal or the fitting of twist locks for transporting a container between the ship and platform than is needed for transporting the container to the set-down track on the surface of the quay.

However, the disclosed solution is disadvantageous, since although the use of the second trolley in the container bridge increases the handling performance, it entails additional, relatively high investment, servicing and maintenance costs. Furthermore, the platform used in the known solution for the fitting and removal of the twist locks is not suitable for handling tank containers or other special containers (for example refrigerated containers or containers for loading passenger cars). Although the set-down surfaces, explained in the citation, for the container permit free access to the corner fittings, in the case of this technique a closed container bottom is absolutely necessary. However, this is not always ensured in the case of special containers. This means that these containers have to be sorted out and have to be handled separately on the quay by additional personnel.

SUMMARY OF THE INVENTION

Starting from the prior art as disclosed by the German Utility Model 297 19 466, the object of the present invention is to provide a device for increasing the performance of a handling apparatus, in particular for ISO containers, which is employed as an inexpensive supplement to the known container handling apparatuses. In addition, the solution, which is cost-effective with regard to procurement and maintenance, is to be suitable for automating the process of the fitting or removal of the twist locks.

In order to achieve the object, the invention proposes that the intermediate positioning of the containers is carried out in a lifting device which can be positioned above the transport vehicles and is suitable for all current ISO container sizes and types and comprises a shaft-like base frame with vertical guides for the container suspended on the spreader, and a lifting frame which engages around the container, is arranged such that it can be raised and lowered underneath the shaft-like base frame and, after the container has been detached from the spreader, can be lowered in the direction of the transport vehicle, together with the container, means for seizing and holding the spreader being provided at the lower end of the base frame and means for seizing and holding the container being provided on the lifting frame, and the platforms for fitting or removing the twist locks being fixed to the lifting device.

Starting from unloading a ship, the novel lifting device according to the invention performs the second part of the handling operation, instead of the second trolley. In this case the container suspended in the corner fittings on the spreader of the trolley of the container bridge is accommodated in the lifting device, specifically irrespective of the size and type of the containers. Since standardized ISO containers are concerned, the novel lifting device is able to use the upper corner fittings, which are always defined clearly in terms of shape and position, to pick up the load. The freely accessible twist locks are removed by the personnel who are located on platforms arranged laterally underneath the containers, so that the automated lifting device can set the container down onto the transport vehicles.

In one embodiment of the invention, provision is made for the lifting device to be arranged in a stationary manner inside the bridge portal of a container bridge, preferably on a connecting beam of the container bridge supports. The lifting device performs part of the handling of the load and therefore reduces the load cycle. The trolley of the container bridge now only ensures the transport of the container between the ship and lifting device, which is firmly connected to the connecting beam of the container bridge supports, to be specific in a position in which the track of the transport vehicle (AGV) runs.

It is more beneficial if, in another refinement of the invention, the lifting device is arranged such that it can be moved inside the bridge portal of a container bridge, preferably on the connecting beam of the container bridge supports. In this case, the connecting beam is the support of the rail running track of a bridge crane, on which the lifting device is fixed such that it can be moved with the latter. In order to transfer the container from the trolley of the container bridge to the lifting device a position is chosen for the lilting device in the container bridge which is optimal for the load cycle. After the lifting device has been loaded, the bridge crane moves under control to a bridge-specific position, determined by a higher-order container terminal logistic system, in order to load the transport vehicle.

The base frame of the lifting device preferably forms a guide shaft which tapers downward, which catches and guides the lowered spreader with the container on its long sides, and which, on its inner sides facing the long sides of the container, is provided with sliding guides which extend vertically and into which two pins engage which can be extended and retracted from the center of the spreader on both sides. The guide shaft catches the container and spreader early, the fine positioning in the longitudinal direction being performed by the extendable pins, by which means the container is moved into the correct locking position.

According to the invention, on the lower end of the base frame, facing the lifting frame, on each long side eight remotely operated load-lifting means locking pins are provided, whose arrangement corresponds with the arrangement of openings in the fittings of the standardized spreader. The invention makes use of the fact that an oval opening is provided in each mounting on the ends of the twist lock mountings of the spreader. A standard spreader has four twist locks, which are set to 20 ft, 40 ft or 45 ft depending on the container size. In the case of a twin-lift spreader, there are two times four twist locks, which are set to 20 ft, 2×20 ft, 40 ft or 45 ft (a maximum of eight positions per size) depending on the container size. Load-lifting means locking pins, on which the spreader is placed when in its final position, move into the oval openings at the ends of the spreader as it approaches. Reversal of the active and passive functions of the load-lifting means locking is conceivable, that is to say the oval openings are located on the lifting device and the load-lifting means locking pins are mounted in the spreader.

Alternatively, on the lower end of the base frame, facing the lifting frame, on each long side eight support points for a maximum of eight hydraulically remotely operated load-lifting means pivoting stops can be provided, which are arranged on the standardized spreader so that they can be pivoted in and out on the twist lock mountings. The support points accept the weight of the spreader and container after the load has been set down.

In addition, the invention provides that, in the upper area of each long side of the lifting frame, eight remotely operated load-locking pins are provided, whose arrangement corresponds with the arrangement of openings in the fittings of the ISO container. After the spreader is resting on the load-lifting means locking pins of the base frame, the load-locking pins of the lifting frame move into the lateral oval openings in the container corners in accordance with the load-dependent spreader setting. It is preferable if, at this point in time, the lifting frame of the lifting device according to the invention is located approximately at a distance of about 50 mm underneath the base frame, base frame and lifting frame being centered in relation to each other.

Moreover, the invention provides that the lifting frame be suspended on four hydraulic cylinders which are fixed to the base frame and aligned vertically and whose piston-rod heads, acting on the lifting frame, are each provided with a slot extending in the lifting direction. The hydraulic cylinders permit the lifting frame to be lifted with respect to the base frame for the purpose of releasing the twist locks, and lowering the ISO container accommodated in the fitting frame in the direction of the quay or transport vehicle.

In another solution, the load-lifting means is provided with hydraulically operated pivoting stops, each of which is arranged on the spreader-twist lock mountings. In accordance with the load-dependent spreader setting, to 20 ft, 2*20 ft, 40 ft or 45 ft depending on the container size, pivoting stops are operated for which, in the base frame, a maximum of eight load-lifting means support points are provided on each long side for the activated load-lifting means pivoting stops of the spreader. These load-lifting means support points accommodate the weight of the spreader and container after the load has been set down.

The sequences are analogous to those in the solution described first.

Alternatively, the lifting frame can also be suspended on four lifting cables of a cable hoist fixed to the base frame, the cables taking over the function of the hydraulic cylinders.

According to a further feature of the invention, in order to fit or remove the twist locks, provision is made for the platform suspended on the lifting device to be displaceable into a working position beside the container and away from the latter into a standby position. The position of the platform is aligned in such a way that the personnel can fit or remove the twist locks, it being beneficial for the bridge crane to move at the same time from the transfer point of the container to the destination point, that is to say generally to the logistically associated traveling track of the transport vehicle. The working platform is displaced into its standby position again after the twist locks have been fitted or removed and before the lifting frame lowers its load.

A working method for operating a lifting device is defined by the following steps: starting from unloading a ship, the container suspended on the spreader is lowered into the lifting device from above and centered at the same time, the spreader is coupled to the lifting device, the load-lifting means locks provided on the base frame (alternatively on the spreader) being used, the container suspended on the spreader is picked up by the lifting frame, the lifting frame using the upper corner fittings whose position is clear on the container, the lifting frame is lifted slightly on the container, the connection between spreader and container is released, the spreader is retracted, the platforms with the personnel are moved up to the container and the twist locks are released, and at the same time as the container, together with the lifting frame and the platforms, which are moving toward the standby position, is moved into its transfer position, the container, still suspended in the lifting frame, is lowered further with the latter until the container has reached the vehicle.

The pivoting stops pivot over the corner fittings of the container while the container, still suspended in the lifting frame, is being lowered further with the latter, until the container has reached the vehicle. The action of setting the container down onto the vehicle has the effect that the slight distance between the pivoting stops and the corner fittings is reduced to zero.

After the locks between the lifting frame and container have been released, the lifting frame is moved back to the base of the lifting device and is ready to accept a new container.

The novel device is advantageous as a cost-effective supplement to known handling apparatuses. Depending on the container handling apparatus, use is made of a stationary or a mobile design. The costs for procurement and maintenance are estimated to be about 30% lower than conventional solutions, as proposed by the generic prior art. The device is suitable for complete automation and can be inserted subsequently into existing systems.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
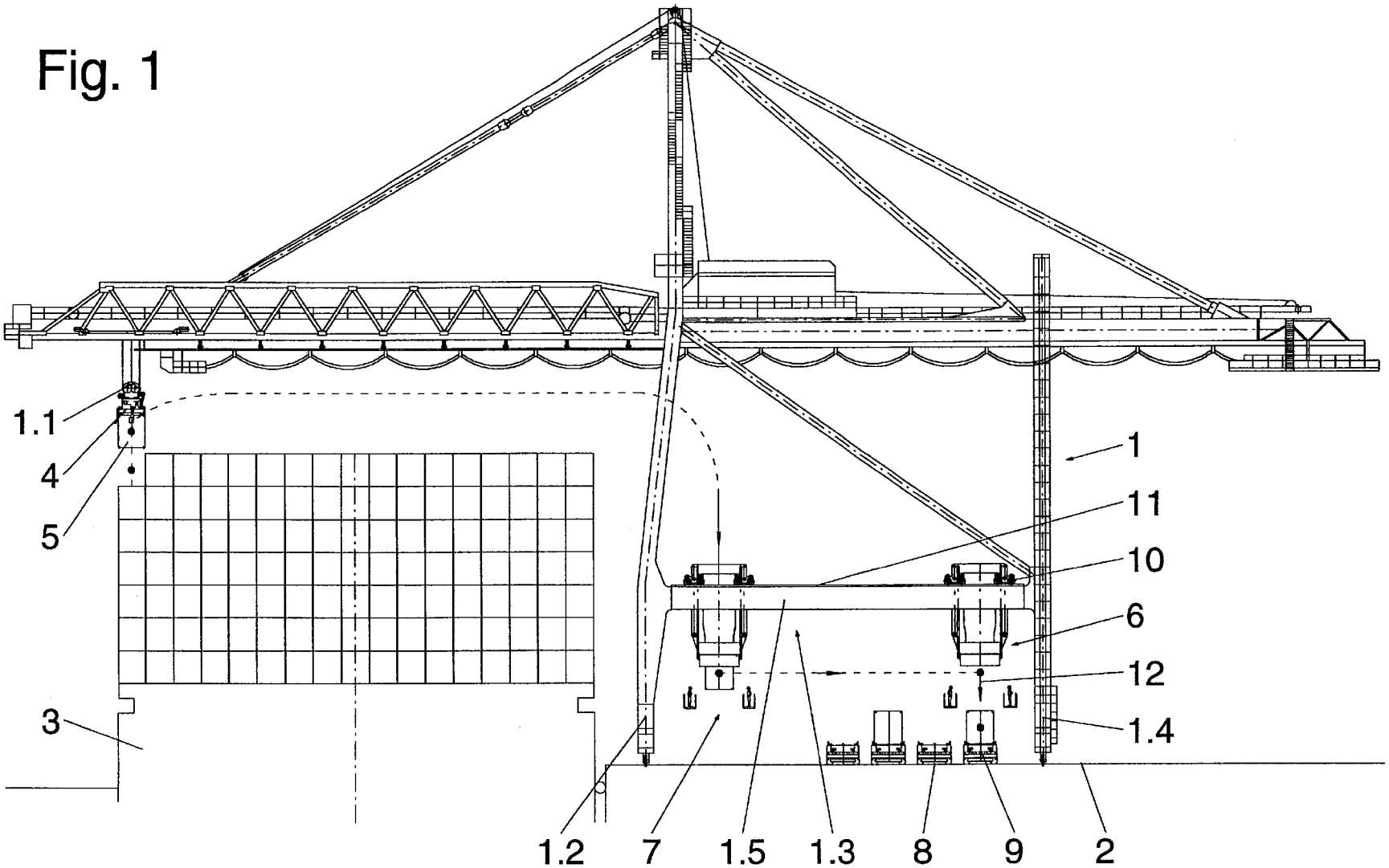
FIG. 1 shows the side view of a container bridge with a lifting device.

FIG. 1 shows a container bridge 1 in front of a container ship 3 lying at the quay 2. The trolley 1.1 of the container bridge transports the container 5 suspended on the spreader 4 to the lifting device 6, which has assumed a trolley loading position 7 close to the support 1.2 on the seaward side. Provided inside the bridge portal 1.3, in the direction of the landward support 1.4, are the traveling tracks 8 of the driverless transport vehicle (AGV) 9. The lifting device 6 is equipped with rail chassis 10 and is moved on two rail running tracks 11 which are located on the support 1.5 above the bridge portal 1.3, into a bridge-specific AGV loading position 12 determined by a higher-order container logistic system.

Figure 2:
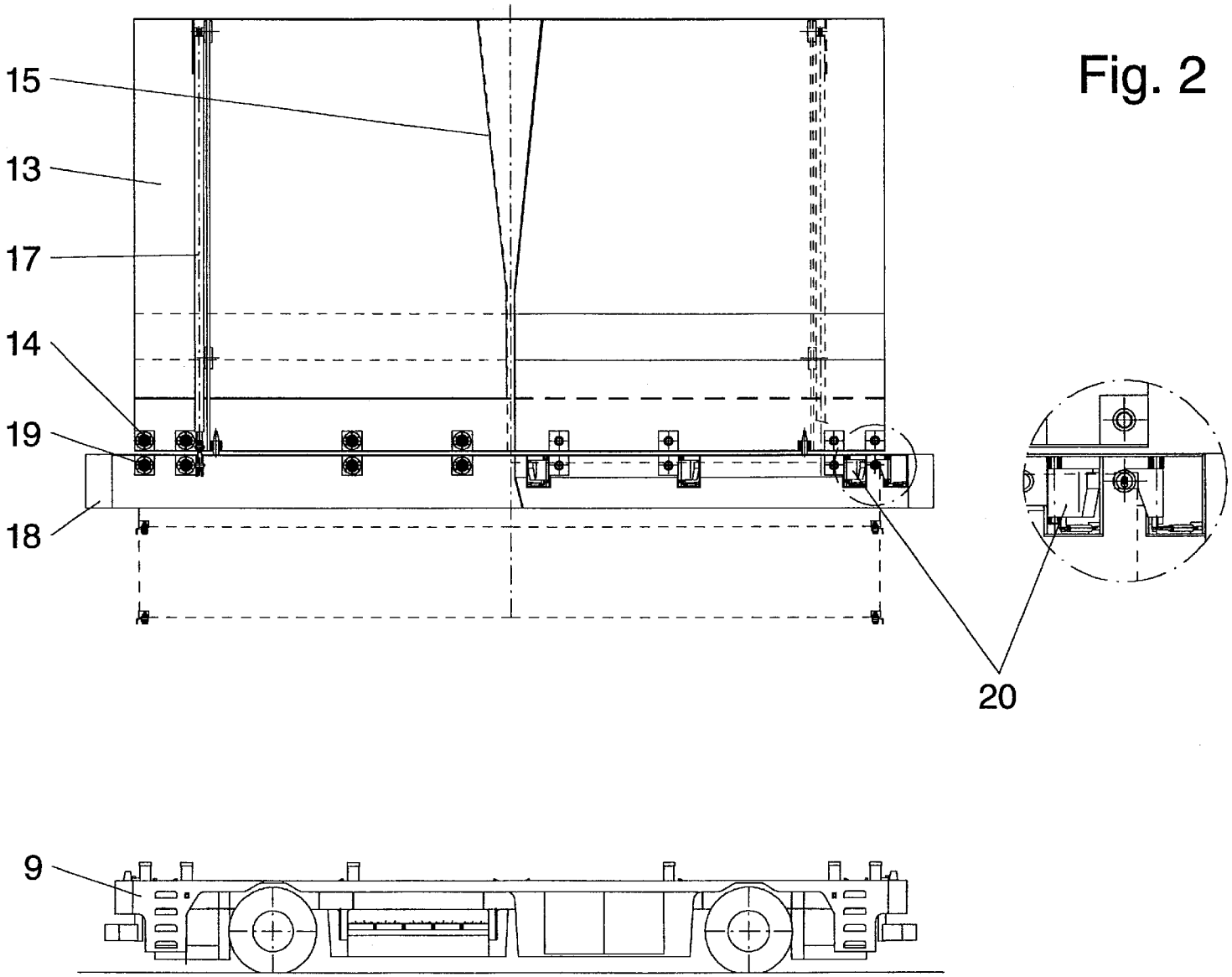
FIG. 2 shows the side view of the lifting device with a 45 ft container.

FIG. 2 shows a half-section through the base frame 13. Mounted on the lower end of the base frame, on each long side, are eight load-lifting means locking pins 14, which are arranged in a way similar to the twist locks of the spreader. At the center of the base frame, it is possible to see one of the two funnel-like guide paths 15 of the two load-lifting means guide pins for the longitudinal positioning of the spreader.

Underneath the base frame, the lifting frame 18 is suspended on four hydraulic cylinders 17. Mounted at the upper end of the lifting frame, on each long side, are eight load-locking pins 19, which are arranged in a manner similar to the load-lifting means locking pins 14 and the twist locks of the spreader. Beside the load-locking pins 19 it is possible to see a similar number of pivoting stops 20. An unloaded AGV 9 is standing in the standby position.

Figure 3:
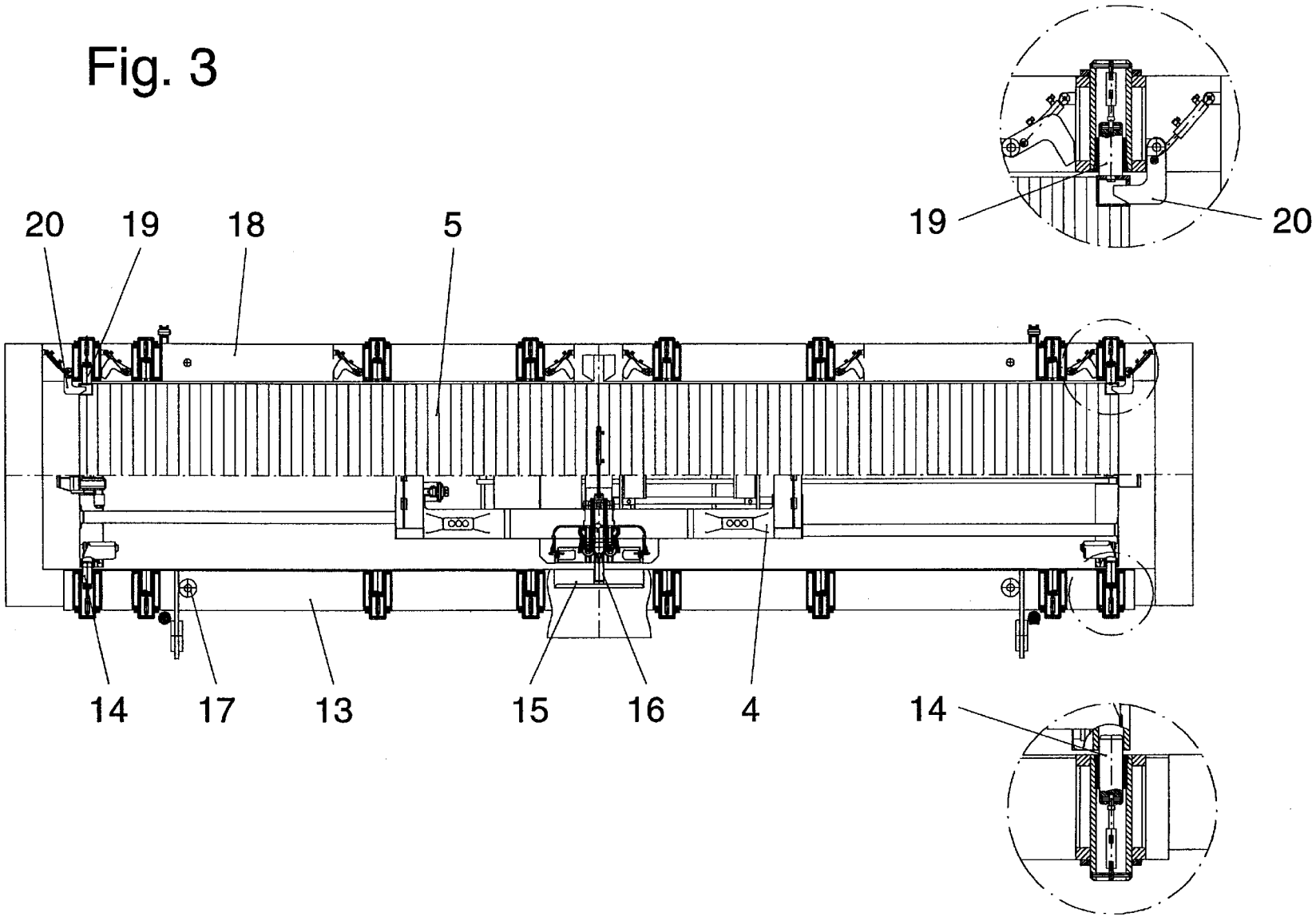
FIG. 3 shows the plan view of the lifting device with a 45 ft container.

FIG. 3 shows the base frame 13, the load-lifting means 4, the load-lifting means locking pins 14, the tunnel-like guide path 15, the load-lifting means guide pins 16, the hydraulic cylinders 17, the lifting frame 18, the load-locking pins 19 and the pivoting stops 20. The pins and stops are activated in accordance with the load 5.

Figure 4:
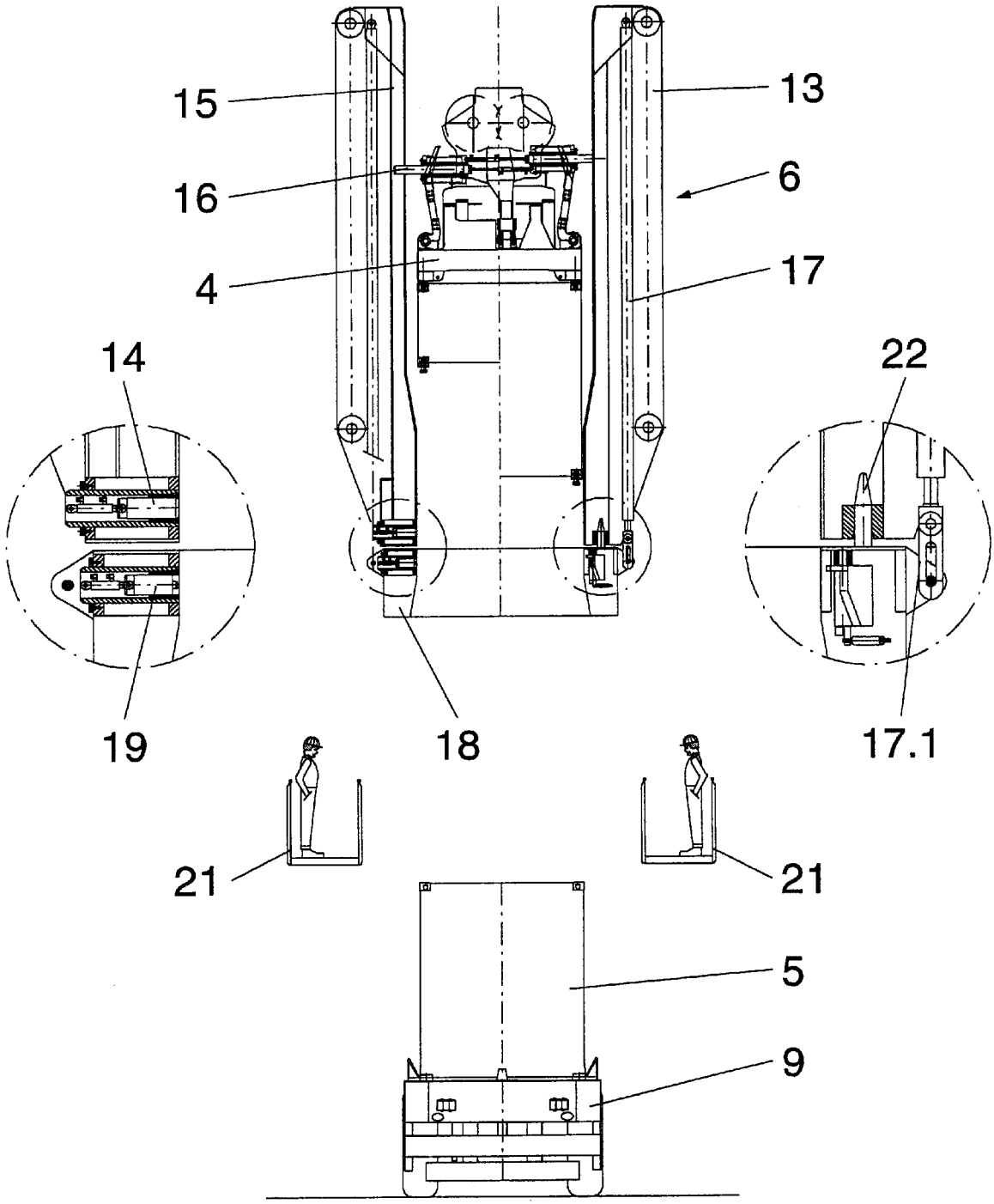
FIG. 4 shows the front view of the lifting device.

The front view of the lifting device according to FIG. 3 is shown in FIG. 4. Identical parts are identically designated. Underneath the lifting device 6 it is possible to see the platforms 21 in the lateral standby position and an AGV 9 loaded with the load 5. The suspension of the platforms on the base frame 13, and their displacement mechanism are not shown.

Figure 5:
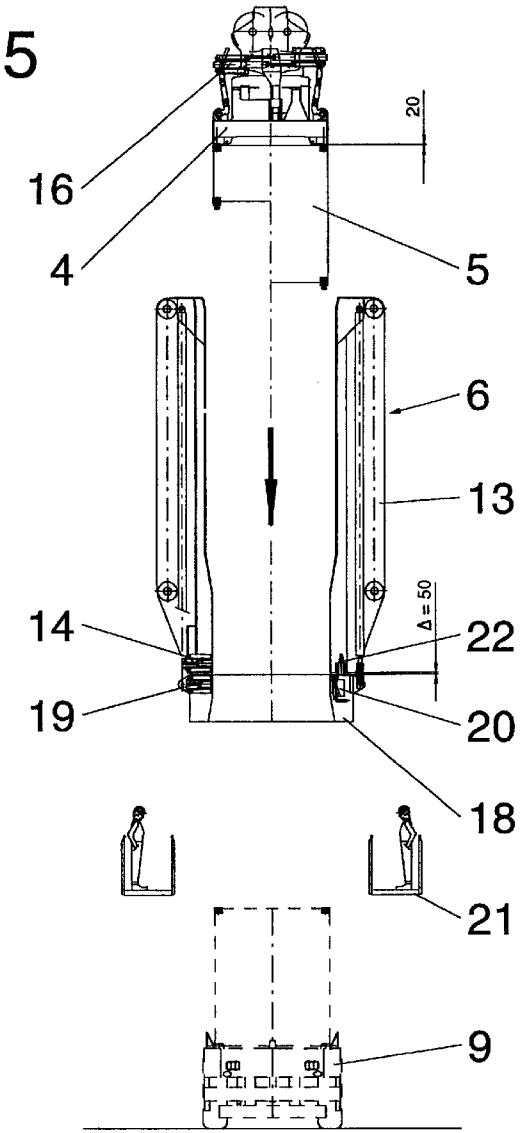

The functional sequence of the device according to the invention is shown in FIGS. 5 to 16. FIG. 5 shows the container 5 suspended on the spreader 4 above the lifting device 6 during the lowering operation at normal lowering speed. The distance between the base frame 13 and the lifting frame 18 is about 50 mm. Underneath the lifting device it is possible to see the platforms 21 in the lateral standby position and a loaded AGV 9 as it travels through. The base frame and lifting frame are centered in relation to each other by means of a fourfold pin guide 22. Load-lifting means locking pins 14, load-lifting means guide pins 16, load-locking pins 19 and pivoting stops 20 are not activated.

Figure 6:
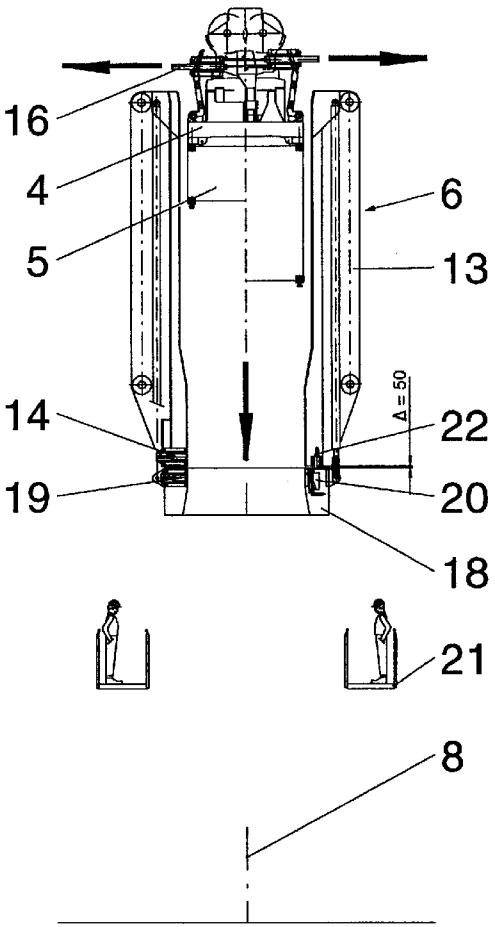
FIGS. 5–16 show the functional sequence of the working method according to the invention.

FIG. 6 shows the container 5 suspended on the spreader 4 inside the lifting device during the lowering operation at reduced lowering speed. The distance between the base frame 13 and the lifting frame 18 is about 50 mm. Underneath the lifting device, the platforms and the AGV traveling track can again be seen. The locking mechanisms have not been activated, the load-lifting means guide pins 16 are being activated.

Figure 7:
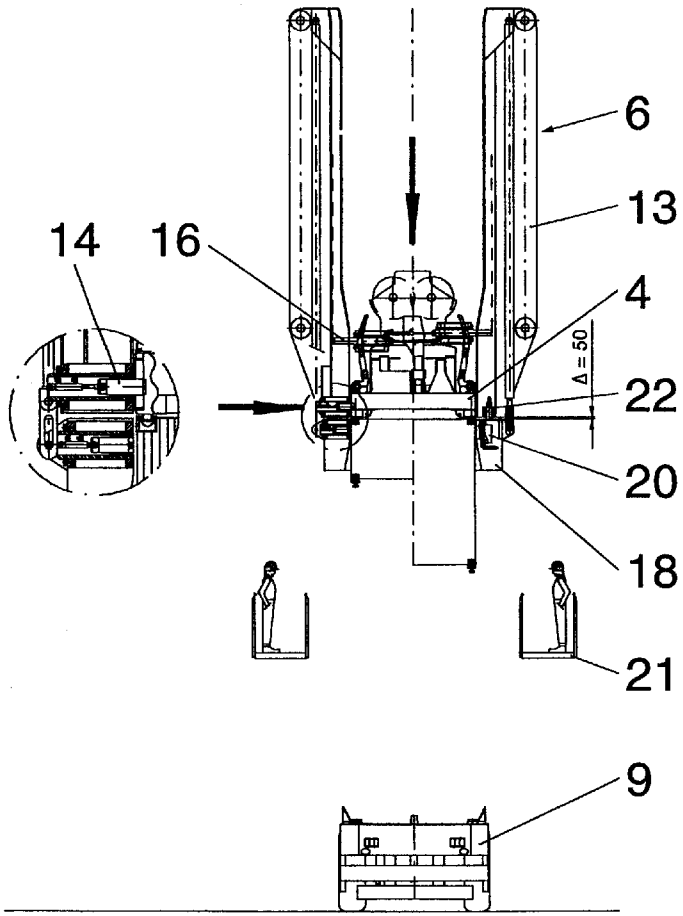

FIG. 7 shows the container 5 suspended on the spreader 4 inside the lifting device 6 during the lowering operation at the lowest lowering speed. The distance between the base frame 13 and the lifting frame 18 is still about 50 mm. Load-locking pins 19 and pivoting stops 20 have not been activated. The load-lifting means guide pins 16 have been activated, the load-lifting means locking pins 14 are being activated.

Figure 8:
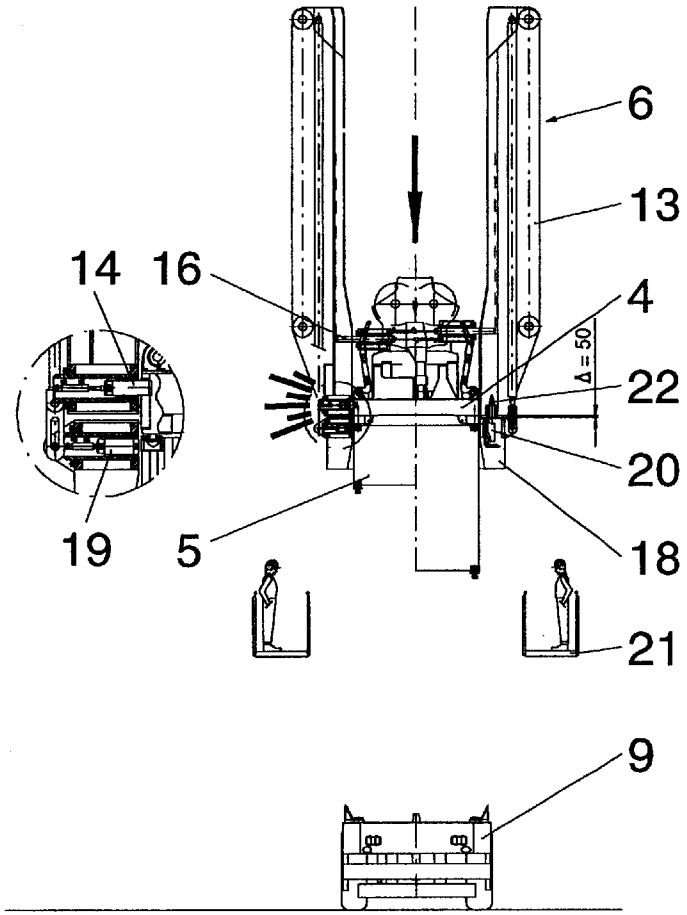

FIG. 8 shows the spreader 4 with the container suspended on it inside the lifting device, still at the lowest lowering speed. The distance between the base frame 13 and the lifting frame 18 continues to be about 50 mm. Load-locking pins 19 and pivoting stops 20 have not been activated. Load-lifting means locking pins and load-lifting means guide pins 16 have been activated. The load-lifting means locking pins 14 are carrying the weight of load and spreader.

Figure 9:
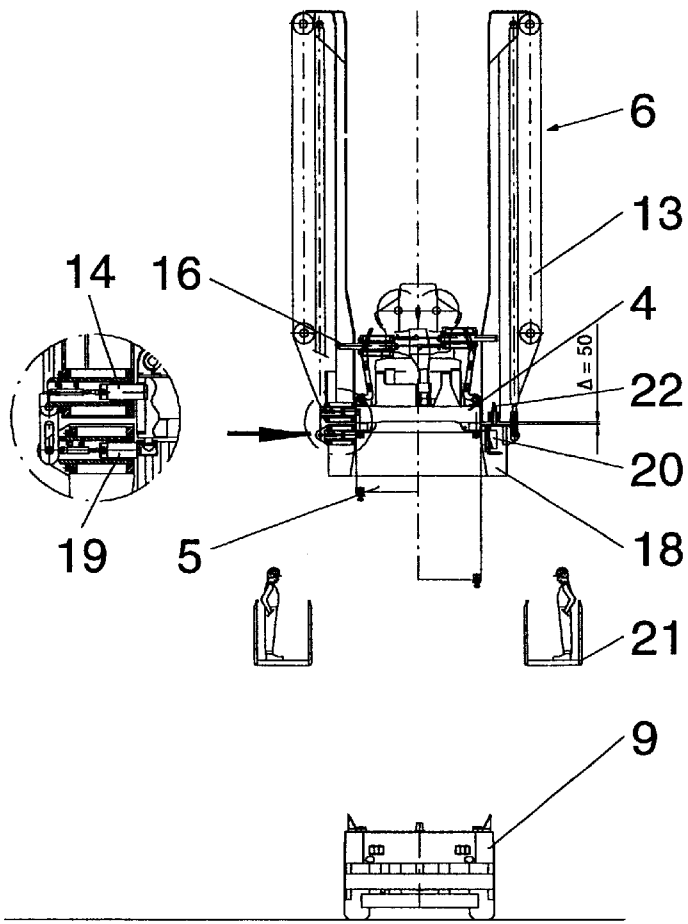

FIG. 9 shows the completed lowering operation of spreader 4 and container 5. The distance between the base frame 13 and the lifting frame 18 is again about 50 mm. The pivoting stops 20 have not been activated; load-lifting means locking pins 14, and load-lifting means guide pins 16 have been activated. The load-locking pin 19 is being activated.

Figure 10:
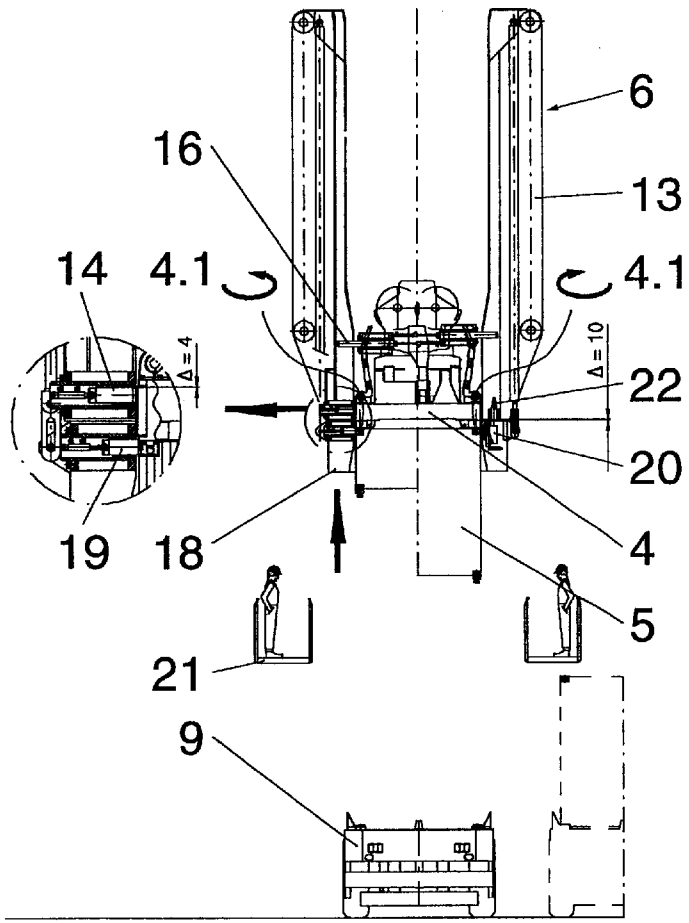

FIG. 10 shows the container 5 suspended on the lifting frame 18 inside the lifting device 6 after the lifting operation of the hydraulic cylinders 17 has been concluded. The distance between the base frame 13 and the lifting frame 18 has now been reduced to about 10 mm. Underneath the lifting device it is also possible to see here the platforms 21 in the lateral standby position and an unloaded AGV 9 and a loaded AGV as they travel through.

The base frame and lifting frame are centered in relation to each other by means of a fourfold pin guide 22, the pivoting stops 20 have not been activated. Load-lifting means guide pins 16 and load-locking pins 19 have been activated. The load-lifting means locking pins 14 and the spreader twist locks 4.1 are being deactivated.

Figure 11:
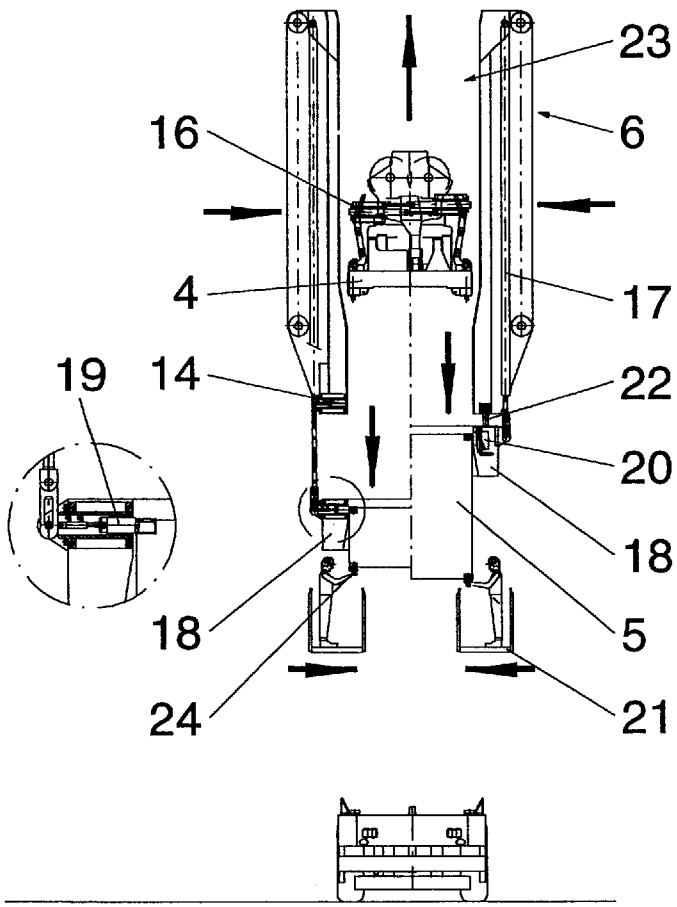

FIG. 11 shows the first part of the lowering operation of the hydraulic cylinders 17 of the lifting device 6. The spreader 4 is beginning a new load cycle and leaving the guide shaft 23. Underneath the lifting device it is possible to see the platforms 21, which are being moved from the lateral standby position into a working position, that is to say in the direction of the load 5. The containers are lowered, depending on their type, until the twist locks 24 at the corners of the container can be reached by the personnel without difficulty. Base frame and lifting frame are no longer centered via the fourfold pin guide 22. The load-lifting means locking pins 14 and pivoting stops 20 have not been activated. The load-locking pins 19 have been activated, the load-lifting means guide pins 16 are being deactivated.

Figure 12:
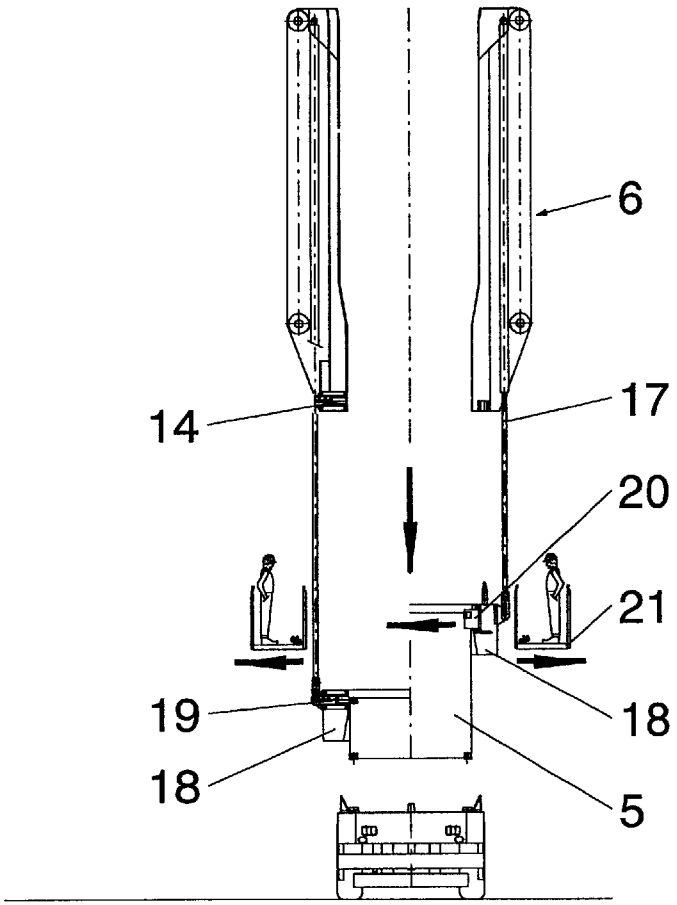

FIG. 12 shows the container 5 suspended on the lifting frame 18 inside the lifting device 6 during the second part of the lowering operation of the hydraulic cylinders 17. The platforms 21 have been moved out of the working position into the lateral standby position again. The load-lifting means locking pins 14 have not been activated. The load-locking pins 19 have been activated, the pivoting stops 20 are being activated.

Figure 13:
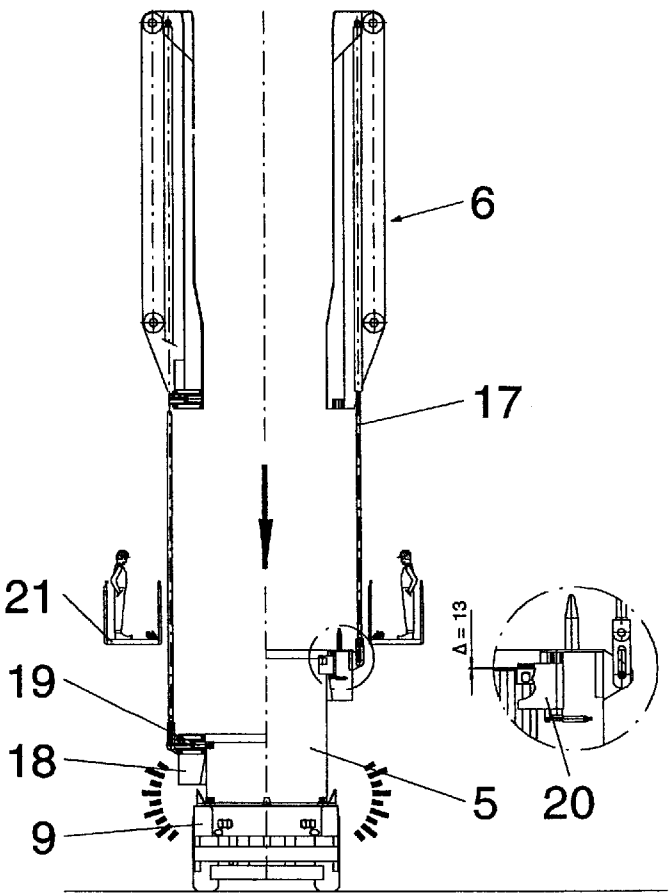

During the third part of the lowering operation of the hydraulic cylinders 17, which is shown in FIG. 13 of the drawing, the platforms 21 are located in the lateral standby position. The container 5 is being lowered onto the AGV 9. The distance between the upper corners of the container and the pivoting stops 20 is about 13 mm. The load-locking pins 19 and pivoting stops 20 have been activated.

Figure 14:
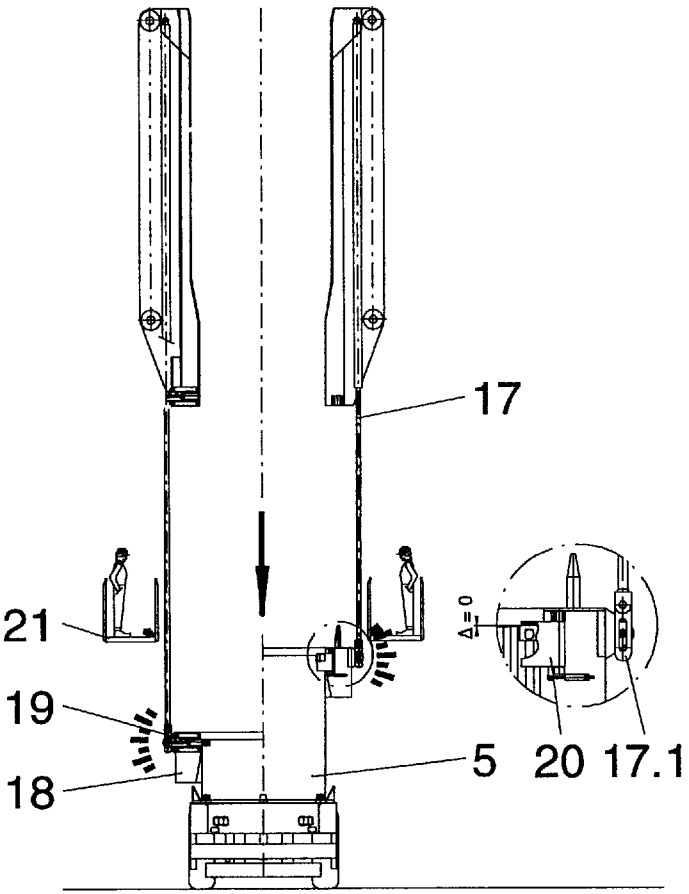

FIG. 14 shows the last part of the lowering operation of the hydraulic cylinders 17. The platforms 21 are still located in the lateral standby position, the lifting frame 18 is being set down with its corner fittings 20 onto the upper corners of the container 5. The cylinder-rod heads 17.1 provided with a slot and belonging to the hydraulic cylinders 17 permit the movements of the apparatuses to be balanced with one another (during the loading operation). The load-locking pins 19 and pivoting stops 20 have been activated.

Figure 15:
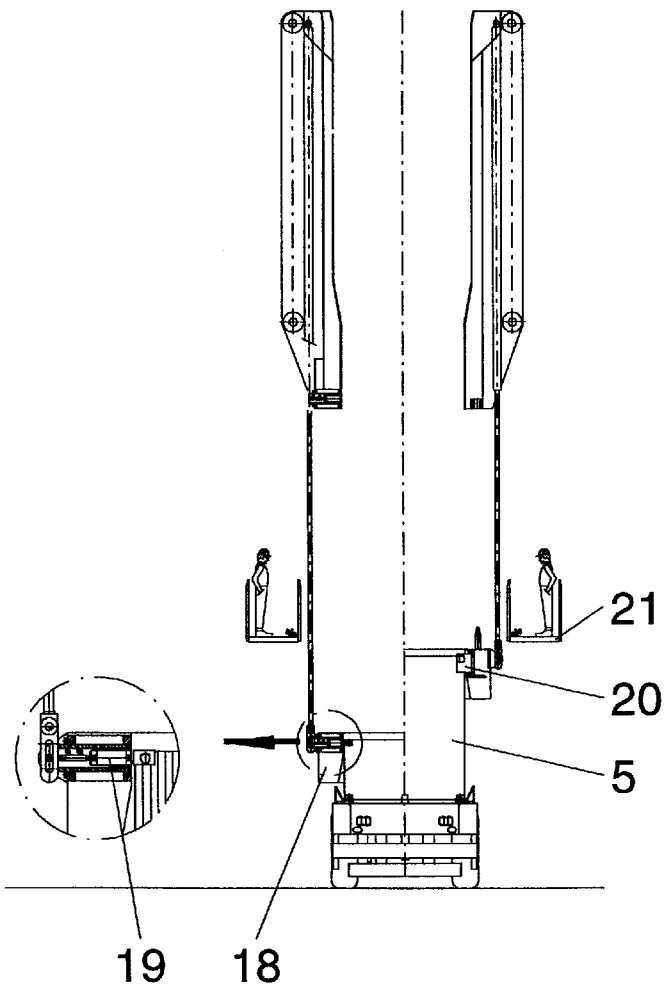

FIG. 15 shows the completed lowering operation. The platforms 21 are located in the lateral standby position, the lifting frame 18 is mounted with its pivoting stops 20 on the upper corners of the container 5. The pivoting stops 20 have been activated, the load-locking pins 19 are being deactivated.

Figure 16:
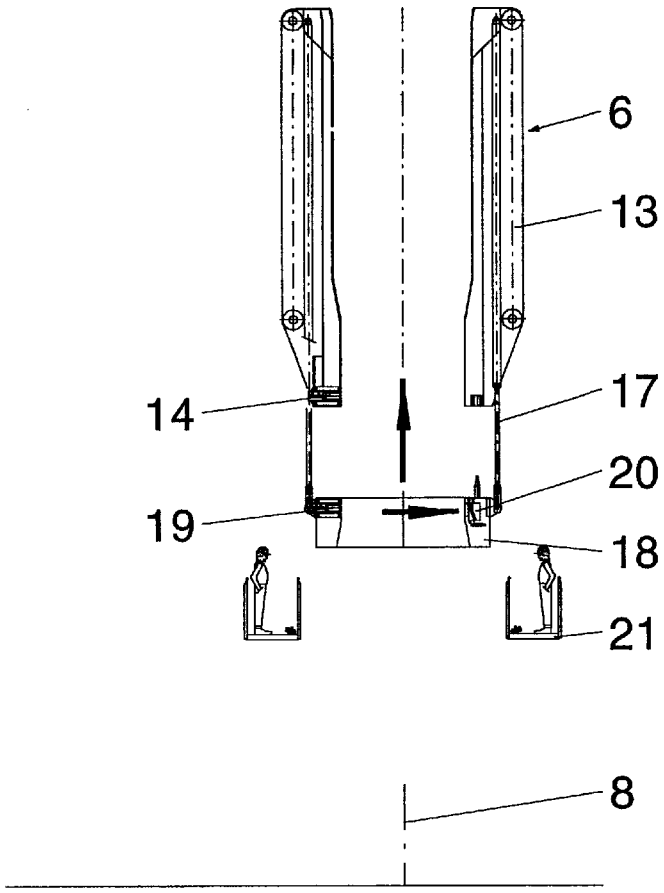

FIG. 16 shows the lifting frame 18 suspended on the hydraulic cylinders 17 as it is lifted in the direction of the base frame 13. Underneath the lifting device 6 it is possible to see the platforms 21 and the AGV traveling track 8. The load-lifting means locking pins 14 and load-locking pins 19 have not been activated, the pivoting stops 20 are being deactivated.

Figure 17:
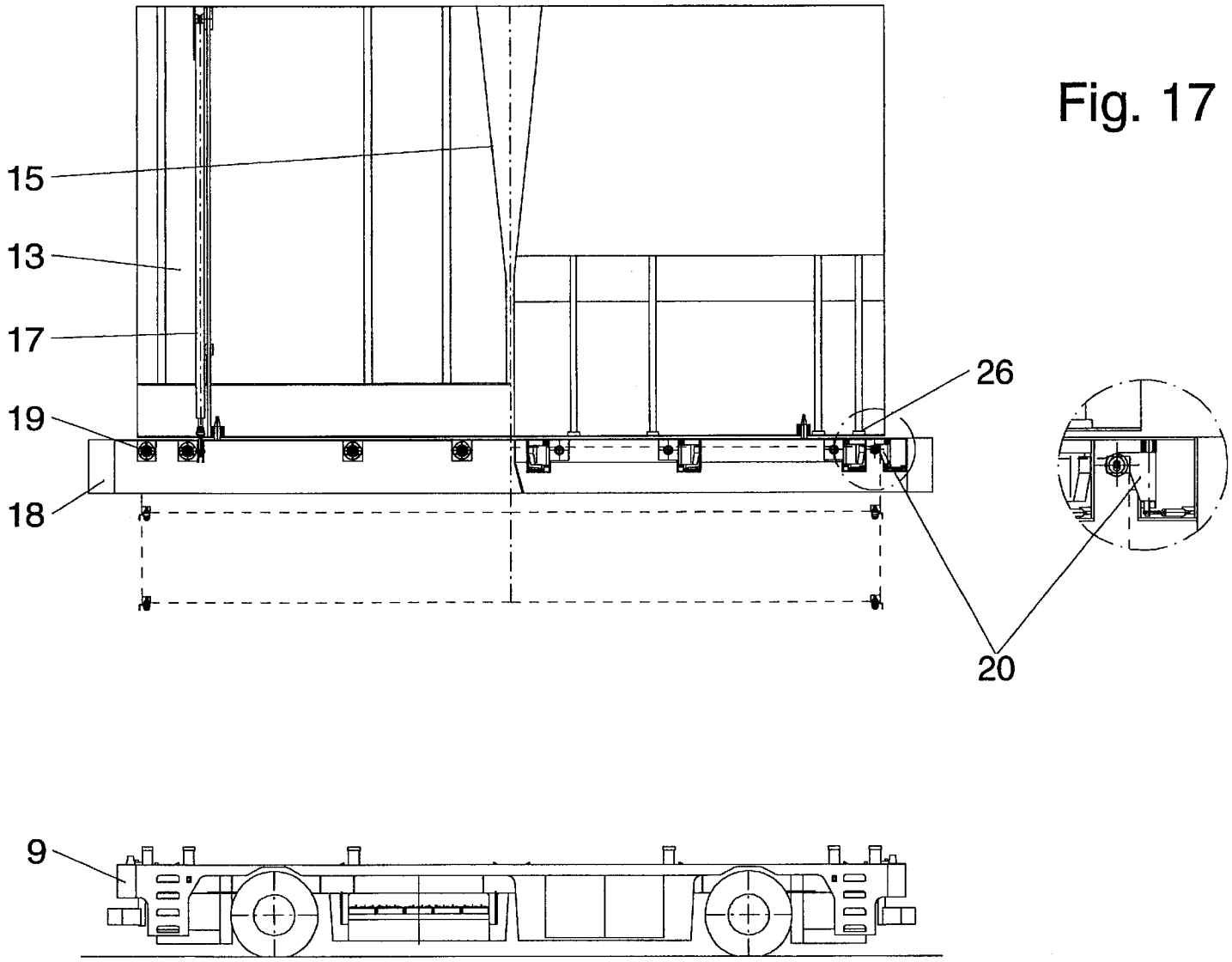
FIG. 17 shows the side view of the lifting device with alternative load-lifting means pivoting stops.
Figure 18:
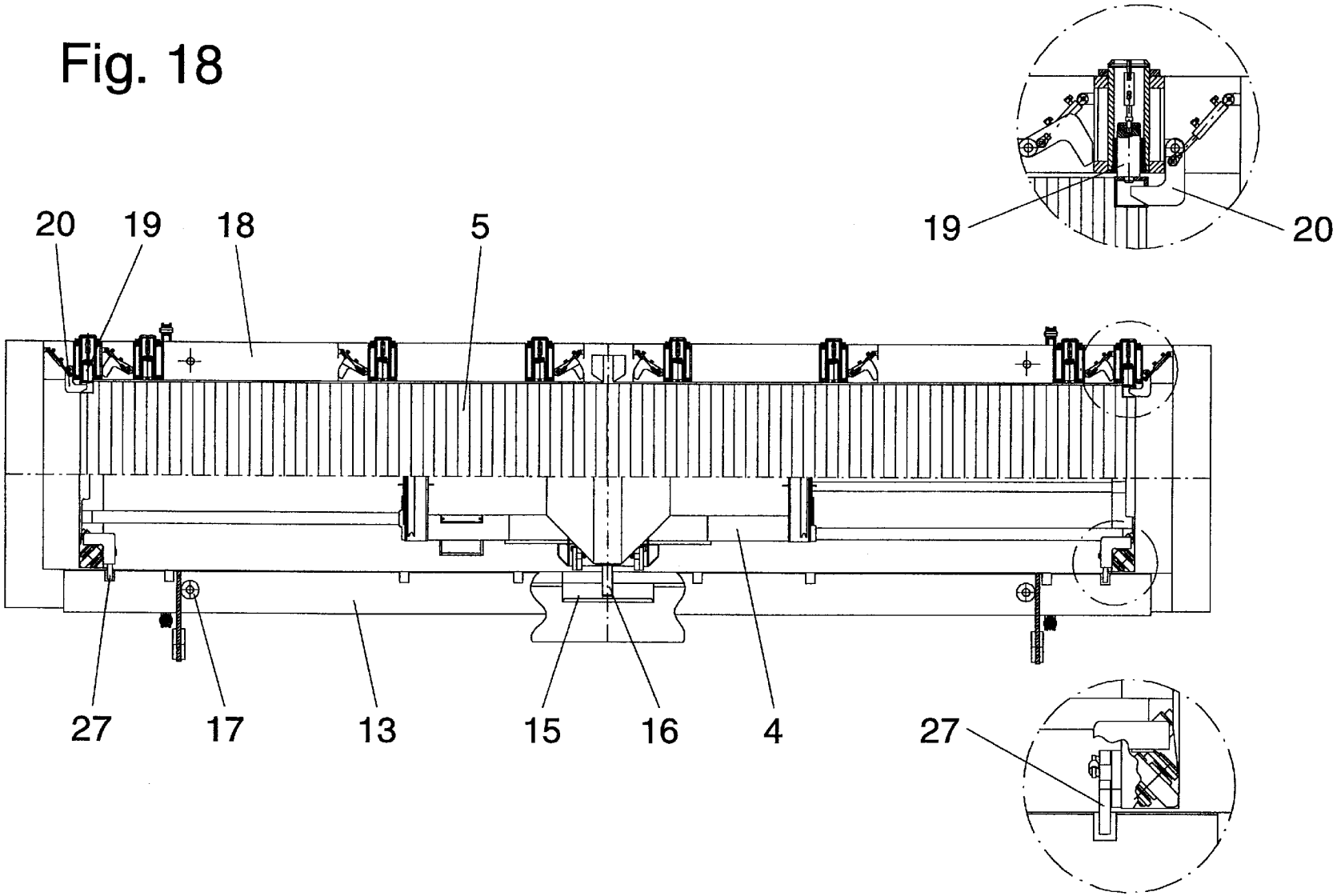
FIG. 18 shows the plan view of the lifting device with the alternative load-lifting means pivoting stops.
Figure 19:
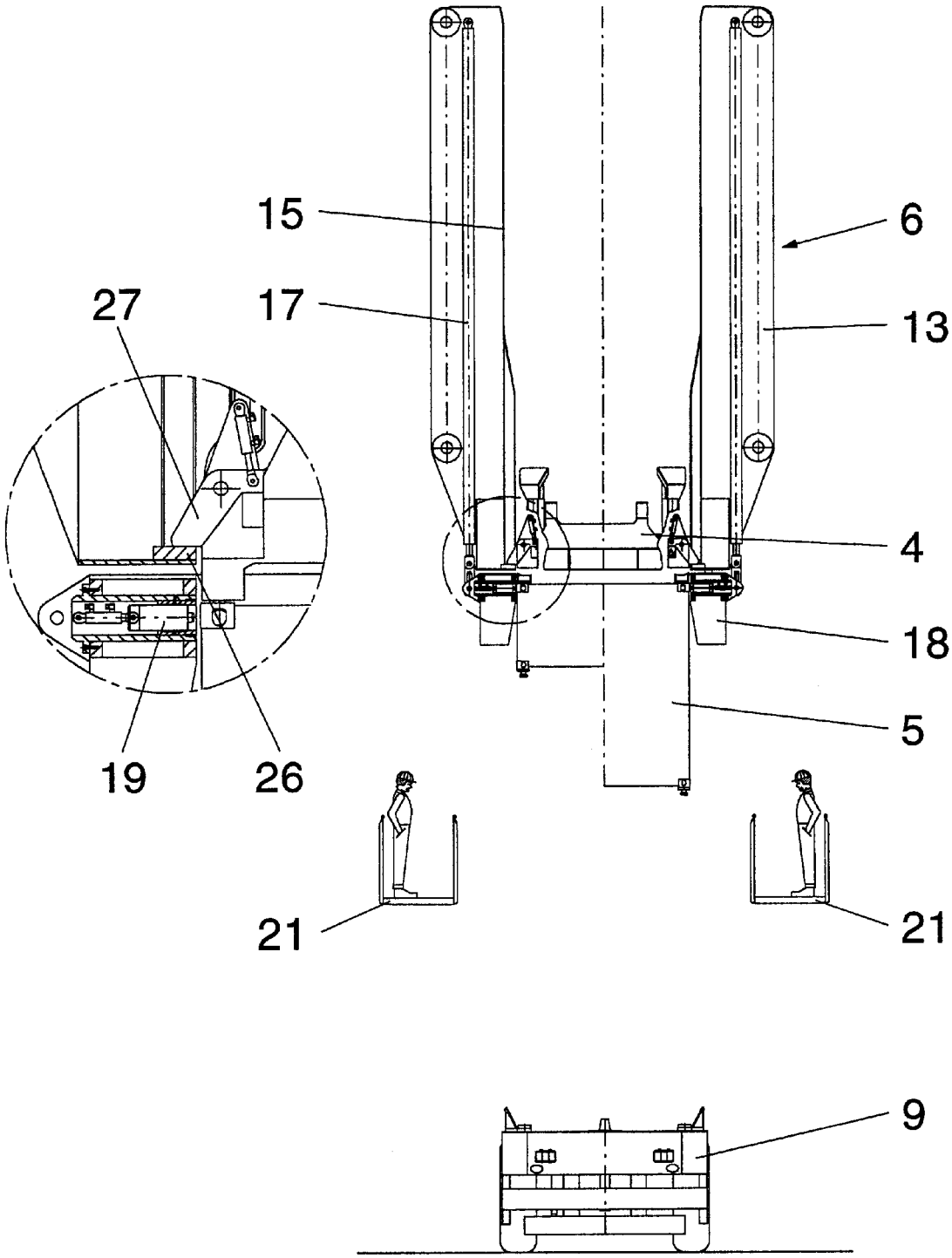
FIG. 19 shows the front view of the lifting device with the alternative load-lifting means pivoting stops.

FIGS. 17 to 19 illustrate, as a supplementary alternative, a locking means for the load-lifting means. The alternative solution shows the load-lifting means with hydraulically operated pivoting stops, which are each arranged on the spreader-twist lock mountings. The pivoting stops are operated in accordance with the load-dependent spreader setting to 20 ft, 2*20 ft, 40 ft or 45 ft, depending on the size of the container.

Provided in the base frame, for the pivoting stops on each long side, are a maximum of eight load-lifting means support points for the activated load-lifting means pivoting stops of the spreader. After the load has been set down, these load-lifting means support points accommodate the weight of the spreader and container. The sequences are analogous to the solution described first.

FIG. 17 shows a half section through the base frame (13). At the lower end of the base frame, on each long side, there are eight load-lifting means support points (26), which are arranged in a manner similar to the twist locks of the spreader. At the center of the base frame, it is possible to see one of the two funnel-like guide paths (15) of the two load-lifting means guide pins for the longitudinal positioning of the spreader.

Underneath the base frame, the lifting frame (18) is suspended on four hydraulic cylinders (17). At the upper end of the lifting frame, on each long side, eight load-locking pins (19) are mounted. Beside them, it is possible to see the identical number of pivoting stops (20). An unloaded AGV (9) is standing in the standby position.

FIG. 18 shows the base frame (13) the load-lifting means (4), the load-lifting means pivoting stops (27), the funnel-like guide path (15), the load-lifting means guide pins (16), the hydraulic cylinders (17), the lifting frame (18), the load-locking pins (19) and the pivoting stops (20). Pins and stops have been activated in accordance with the load (5).

FIG. 19 shows the base frame (13), the load-lifting means (4), the load-lifting means support points (26), the load-lifting means pivoting stops (27), the funnel-like guide path (15), the hydraulic cylinders (17), the lifting frame (18) and the load-locking pins (19).

Underneath the lifting device (6) it is possible to see the platforms (21) in the lateral standby position and an unloaded AGV (9). The suspension of the platforms on the base frame (13) and their displacement mechanism are not illustrated.

Figure 20:
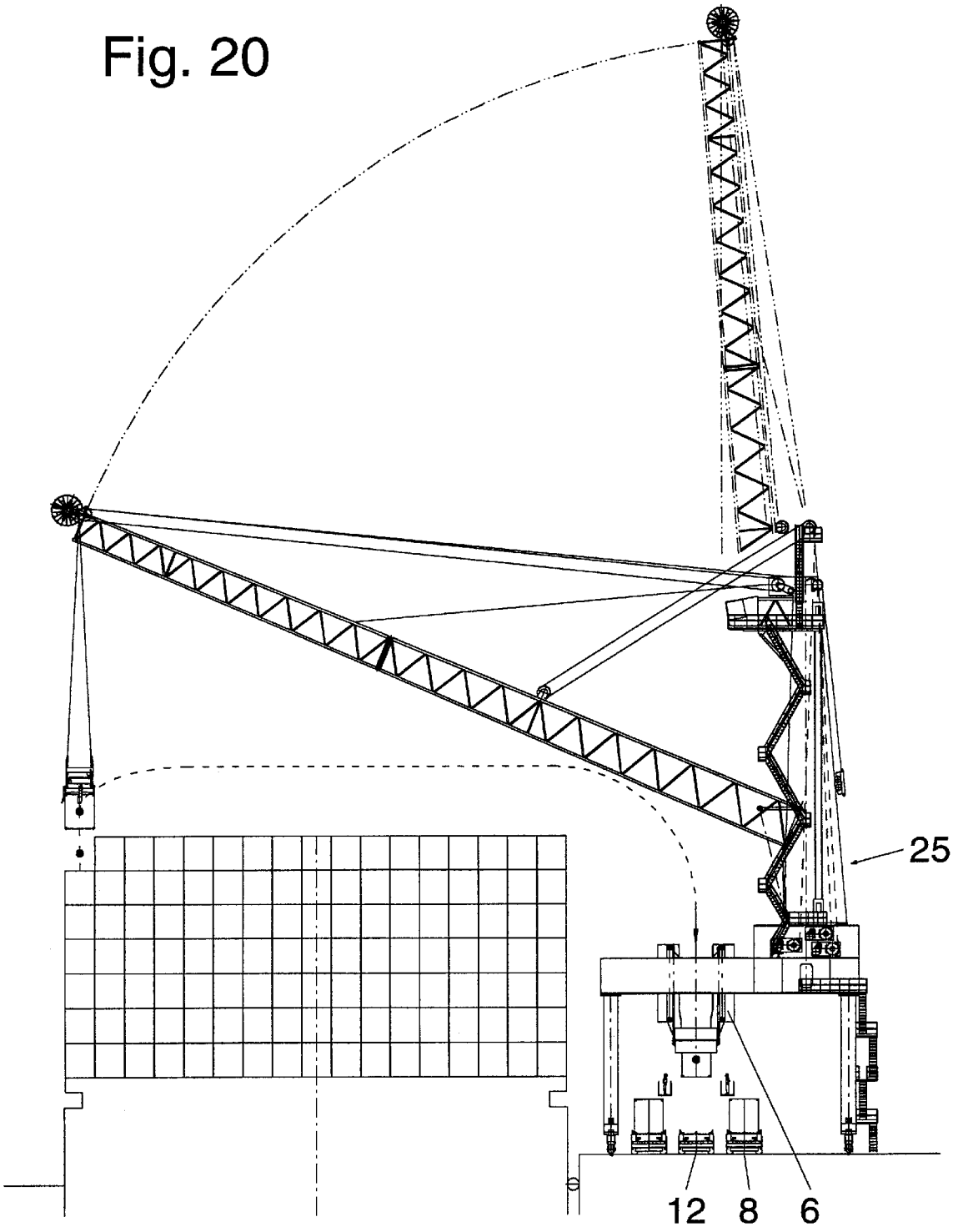
FIG. 20 shows the side view of a mobile dock crane with the lifting device according to the invention.

In a modification, in order to handle ISO containers by means of a mobile dock crane, the present invention can also be used in its crane framework. FIG. 20 of the drawing shows the use of the lifting device 6 in schematic form in interaction with a mobile dock crane 25. The AGV loading position 12 is located underneath the lifting device, which is permanently bolted to the crane. Further AGV traveling tracks 8 are preferably provided on the left and right of the loading position.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A lifting device for handling ISO containers, comprising;

a shaft-like base frame, said base frame having opposite sides defining a guide shaft for reception between said opposite sides of a spreader lowered into said guide shaft from an above location, a container being locked suspended from the spreader;

vertical guides carried on said base frame opposite sides for guiding reception of the spreader and container in said guide shaft;

first seizing and holding devices carried at a lower end of said base frame and operative for holding the spreader and the container suspended therefrom;

a lifting frame located below the base frame, said lifting frame being movable vertically downward and upward relative to the base frame;

second seizing and holding devices carried on the lifting flame and operative for holding said container so that said container can be unlocked from said spreader and lowered with said lifting frame to a transport vehicle; and personnel work platforms movable from a platform standby location to a work location proximal a descent course of said lifting frame at which twist locks can be fitted to and removed from said container.

2. A lifting device according to claim 1, wherein the lifting device is fixable to support beam.

3. A lifting device according to claim 1, wherein the lifting device is mountable on support beam for movement to selected locations along said support beam.

4. A lifting device according to claim 1, wherein the vertical guides taper downward, the spreader carrying pins which follow the taper of said guides for effecting longitudinal positioning of said spreader and container in said base frame.

5. A lifting device according to claim 1, wherein the first seizing and holding means carried on said base frame comprises a plurality of remotely operated load-lifting means locking pins provided in each of said base frame opposite sides, the locking pins on said base frame being arranged in companion correspondence with fitting openings in said spreader.

6. A lifting device according to claim 5, wherein the load-lifting means locking pins provided on each of said base frame opposite sides comprise eight in number.

7. A lifting device according to claim 1, wherein said first seizing and holding devices comprise a plurality of support points carried on a lower part of each of the opposite faces of said base frame, said spreader carrying a corresponding plurality of hydraulically remotely operated load-lifting means pivoting stops that can be pivoted in and out on container twist lock mountings, the load-lifting means pivoting stops setting down on said support points, said support points supporting the weight of the spreader and the container.

8. A lifting device according to claim 7, wherein the support points carried on each of said base frame opposite faces comprise eight in number.

9. A lifting device according to claim 1, wherein said second seizing and holding means comprises a plurality of remotely operated load-lifting means locking pins carried in each of opposite long sides of said lifting frame in companion correspondence with fitting openings in said container.

10. A lifting device according to claim 9 wherein the load-lifting means locking pins carried on each of said opposite long sides of said lifting frame comprise eight in number.

11. A lifting device according to claim 1, comprising:

a plurality of vertically aligned hydraulic cylinders fixed to said base frame, each hydraulic cylinder having a piston-rod head from which said lifting frame is suspended, said piston-rod heads being slotted in a lifting direction.

12. A lifting device according to claim 11, wherein said hydraulic cylinders comprise four in number.

13. A lifting device according to claim 1, wherein the lifting frame is suspended from hoisting cables fixed to said base frame.

14. A method of handling ISO containers at a terminal operation having transporting of containers on transport vehicles, comprising:

attaching a container load-lifting spreader to a container to be handled;

moving the spreader with the attached container to a position above a lifting device;

lowering the spreader and attached container into the lifting device and centering the spreader in the lifting device;

coupling the spreader to a lifting device base frame with load-lifting locks to suspend the spreader from the base frame;

coupling upper corner fittings of the container to a lifting device lifting frame to suspend the container from the lifting frame;

uncoupling the spreader from the base frame and the container, and retracting said spreader from the lifting device;

moving platforms with working personnel thereon proximal a lower side of the container for the personnel to release twist locks of the container; and lowering the lifting frame to the place the container suspended therefrom onto a vehicle.

15. A method of handling containers according to claim 14, wherein during uncoupling of the spreader from the container, the lifting frame and container are lifted with respect to the base frame so that container twist locks can be released.

16. A method of handling containers according to claim 14, wherein to separate the container from the lifting frame, the lifting frame as the container is set down on the vehicle is placed with pivoting stops thereof pivoted over the corner fittings of the container, and a load lifting lock of lifting frame is released from the container.

17. A method of handling containers according to claim 14, wherein at the same time that the twist locks are released, the container together with the lifting frame and the platforms, is moved to a transfer position from which it is lowered onto the vehicle.

18. A lifting device according to claim 3, wherein the lifting device is mountable on the structure of a mobile dock frame.

* * * * *